US005185902A

United States Patent [19]

Fong

[11] Patent Number: 5,185,902

[45] Date of Patent: Feb. 16, 1993

[54] FOLDING POCKET BRUSH AND SHOEHORN

[76] Inventor: James C. Fong, 1303 Folsom St., San Francisco, Calif. 94103

[21] Appl. No.: 723,207

[22] Filed: Jun. 28, 1991

[51] Int. Cl.[5] ..... A46B 7/00; A46B 7/10

[52] U.S. Cl. ..... 15/105; 15/185; 132/122; D4/116

[58] Field of Search ..... 15/105, 185, 169, 184, 15/203; 132/121, 123, 129, 151; D4/116, 118; D32/47

[56] References Cited

U.S. PATENT DOCUMENTS

| | | | |
|---|---|---|---|
| D. 196,293 | 9/1963 | Laitner | D4/116 |
| D. 305,962 | 2/1990 | Ibanez | D4/116 |
| 1,132,126 | 3/1915 | Sharp | 15/185 |
| 3,648,321 | 3/1972 | Vallis | 15/185 |
| 4,057,867 | 11/1977 | Ballin | 15/185 |
| 4,346,496 | 8/1982 | Murray | 15/203 |
| 4,467,491 | 8/1984 | Dekker | 15/185 |
| 4,987,633 | 1/1991 | Heneveld | 15/185 |
| 5,003,658 | 4/1991 | Rolleri | 15/185 |

*Primary Examiner*—Philip R. Coe
*Assistant Examiner*—Patrick F. Brinson
*Attorney, Agent, or Firm*—Joseph L. Strabala

[57] ABSTRACT

A collapsible hair brush employs a flat rectangular flexible membrane with a plurality of bristles projecting perpendicularly from one of its flat surfaces with this membrane having its opposite edges journalled on two spaced-apart, parallel elements which elements are disposed at a width less than the width of the membrane whereby the membrane will have an arcuate configuration when assembled on said elements and can be pushed to one side of the elements to open the bristles and the other side of the elements to close the bristles, along with a handle hinged to the brush which can be folded over the membrane when the bristles are closed to make a compact unit for storage.

5 Claims, 3 Drawing Sheets

FOLDING POCKET BRUSH AND SHOEHORN

BACKGROUND OF THE INVENTION

This invention expands the use of hair brushes as well as providing a design which makes possible mass production and rapid assembling of hair brushes for practical use. A series of market surveys was conducted to find out the model of hair brush most ideal for busy consumers. Out of research this new model hair brush was developed which is featured for its multi-purpose uses, portability and low cost.

The advantages of the present invention are as follows:

The novel brush design provides a folded configuration for carrying convenience without limiting its utility;

The novel brush also has a double function, being useful as both a hair brush and a shoehorn;

The present invention is designed for mass production which cuts down its cost, making it available to the consumer at bargain prices;

The flexibility of the plastic materials used in its construction ensures that no additional components will be required to join its parts whereby it can be assembled rapidly and more economically; and Its membrane bristle design enables the brush bristle to be collapsed and kept in a bundle in the central part of the brush section without causing interference or hindrance among its bristles that could lead to distortion.

Summarizing the above description of the novel brush, it can be concluded that the structure and mode of assembling of the present invention are unique to its design. It is, therefore, regarded as innovative.

SUMMARY OF THE INVENTION

A foldable hair brush, which also functions as a shoehorn, includes a handle means having the shape of a shoehorn and a pivot element at one end, plus a brush portion having a central section or base portion and a u-shaped bow with spaced apart legs extending from it is central section with the central section having pivot elements formed at its end opposite the bow along with means connecting the pivot elements of the handle with the pivot elements of the brush portion, and a flexible, generally rectangular bristle membrane having a plurality of bristles extending normal from one of its surfaces, with the membrane means having cylindrical sleeves along its opposite sides with the cylindrical sleeves operably assembled on the legs of said u-shaped bow whereby its bristles can be exposed and closed by pushing the membrane from one side to the other side of the u-shaped bow due to the greater width of the membrane than the width of the legs and the handle can be closed over said bristles when they are closed to form a compact unit when the brush is not in use.

DESCRIPTION OF THE DRAWINGS

For the purpose of enabling those skilled in the art to better understand the structure, function and features of the present invention, a more detailed description is coordinated with the drawings, wherein.

DESCRIPTION OF A PREFERRED EMBODIMENT

Figure 1:
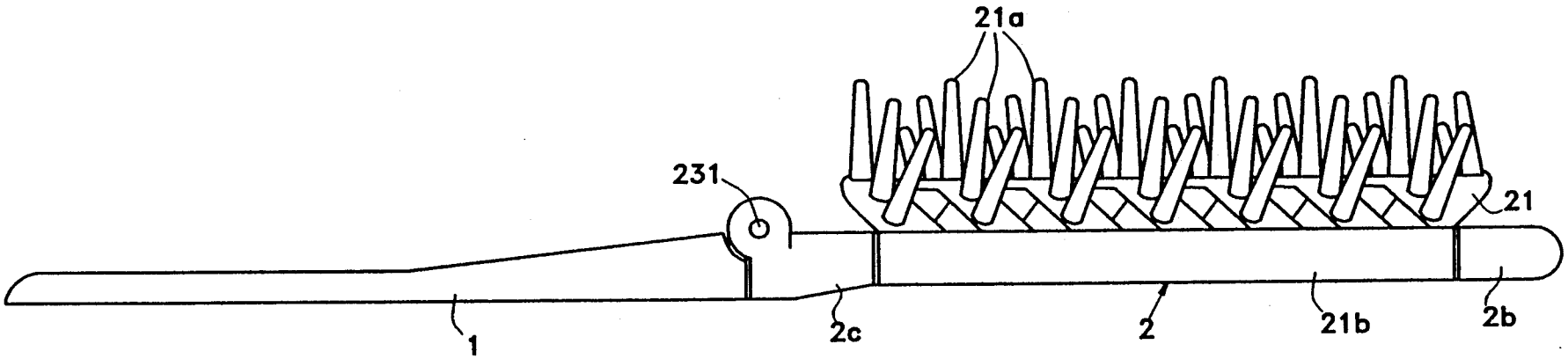
FIG. 1 is a side elevation of the present invention in its open position as it is when used when employed as a brush or comb.

As shown in FIG. 1, the present invention has two principal components, a handle 1 and a brush or bristle section 2. The aforementioned handle 1 is shaped like a shoehorn, having two spaced apart pivots 11 and 12 at one end. Actually the handle can be used as a shoehorn if desired. Pivots 11 and 12 are formed as circular elements 112 and 122 attached at one end of the handle 1 as shown in FIG. 2.

Figure 2:
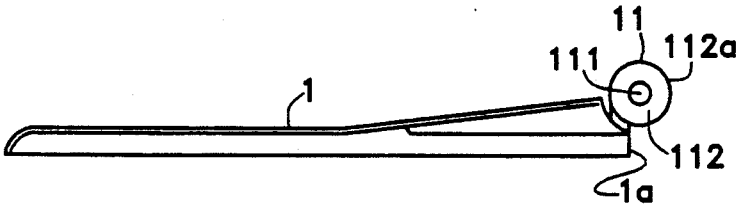
FIG. 2 is a side elevation of the handle of the brush of the present invention.
Figure 3:
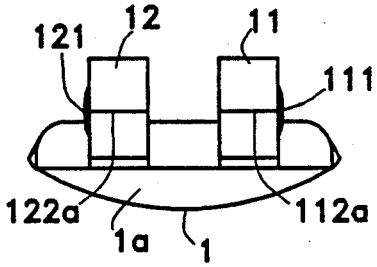
FIG. 3 is an end elevation of the joint section of the handle of the brush of the present invention.

Axial located on the outer lateral surfaces or faces of each of the elements 112 and 122 are short, projecting bosses or studs 111 and 121 which have rounded distal ends, as can be seen in FIGS. 2 and 3. By means of these short bosses or studs 111 and 121 the handle 1 can be attached to the bristle portion 2 of the novel brush in a manner which allows the handle to articulate about an axis formed by the studs when they are received in the mating parts of the bristle portion of the brush.

Figure 5:
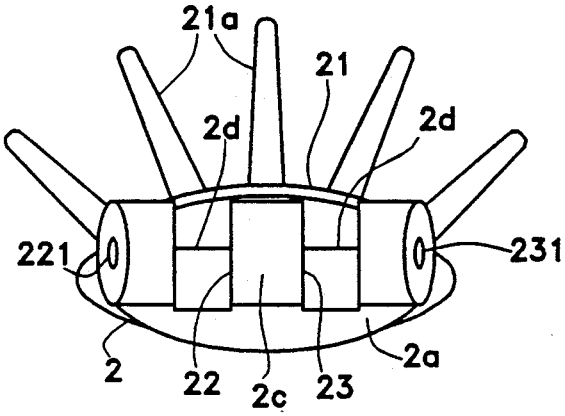
FIG. 5 is an end elevation of the brush section with the bristles extended for use.
Figure 6:
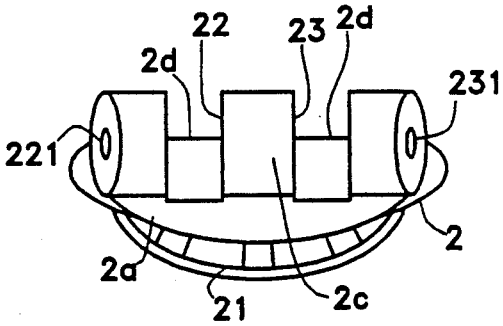
FIG. 6 is an end elevation as shown in FIG. 5 but with the bristles closed.

In FIGS. 5 and 6 the pivot end of the bristle portion or section 2 of the brush is shown. This section contains a flexible membrane 21 on which the bristles **21*a* of the brush are located. The pivot is formed using a cylinder having the same diameter as the circular elements 112 and 122 which includes two spaced apart notches 22 and 23 that divide the cylinder into three parts. The notches are sized to the same width of the circular elements 112 and 122 and thus are slightly distorted when these elements are inserted into the notches 22 and 23 because of the bosses or studs 111 and 121** on the outer faces of these circular elements.

Figure 7:
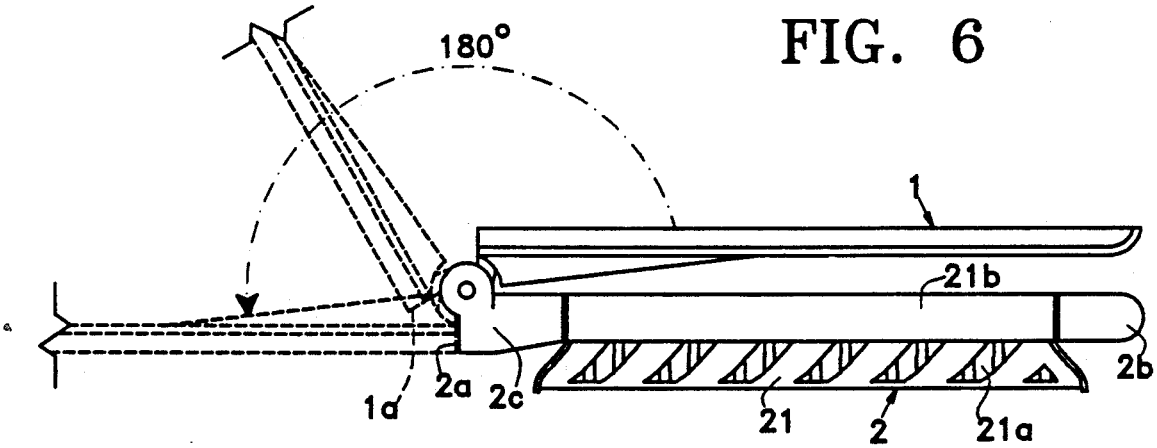
FIG. 7 is a side elevation illustrating how the handle of the novel brush can be folded and opened relative to its brush portion.

As can be seen in FIGS. 5 and 6 the outermost parts of the three-piece cylinder formed by the notches 22 and 23, each have bore 221 and 231 which are axially aligned with one another. Thus, when the circular elements 112 and 122 of the handle 1 are received or interlaced in the notches 22 and 23 as shown in FIG. 1 and FIG. 7, the aforementioned bosses or studs 111 and 121 will snap into these bores 221 and 231 on the brush section 2 joining the handle 1 so it can be articulated about the joint formed thereby, as is best shown in FIG. 7. This joint is a tight fit so that friction in the joint prevents the handle from flopping back and forth.

One feature of the present invention lies in the design on the pivot connection where handle 1 and the bristle section or portion 2 of the brush are joined. In the structure, as mentioned previously, pivots 11 and 12 of the handle 1 form the pivot when aligned in notches 22 and 23 of the bristle section 2. To ease the assembly of the handle with the brush section assembling, grooves 222 and 232 are formed in the outer face of each notch so it is possible to press bosses or studs 111 and 121 through the grooves to get them to a location mate with the bores 221 and 231 for joining the components (see FIG. 4). As these studs are received in the bores, the snap or pop will be heard and will denote that the bosses or studs 111 and 121 are properly received with the bores or holes 221 and 231. As indicated, this arrangement will form a joint with axis which allows the handle 1 to rotate through 180 degrees about this axis as can be seen in FIG. 7.

FIG. 7 shows the handle 1 closed on the bristle section 2 which is the configuration of the present invention for storage. When it is necessary to use the present invention, the handle 1 is opened until it becomes a straight line parallel with bristle section 2, as shown in FIG. 1, when it rotates on pivots 11 and 12. In the straight or open position the handle will stop due to the abutting surfaces 1*a* and 2*a* respectively between the handle and the brush portion, as best shown in FIG. 7. As shown in FIG. 7 of the drawings the handle of the brush swings through an arc of 180 degrees.

As shown in FIG. 1, the present invention can be used for multi-functions, either as a shoehorn (by using the outer end part of the handle 1 which resembles the shape of a conventional shoehorn) or as a brush for combing hair (using the bristle portion or section 2).

The process of carrying or storing the present invention in its folded configuration will not hinder its use because the handle 1 and the bristle section 2 are joined together by a strong joint formed with the bosses or studs 112 and 122 and the interlaced pivot parts so no bending will occur at the time of using when the handle is fully opened.

On the outer periphery of the circular elements 111 and 121 are raised tabs 111*a* and 121*a* which form a projection on the cylindrical surface of these elements. When the handle 1 is opened to its full extent these tabs abut against locking surfaces 2*d* on the brush section 2 which lock the handle in the open position. These locking tabs ensure the handle will not fold until after considerable pressure is applied across the pivot to force the tabs past the locking surfaces 2*d*.

Figure 4:
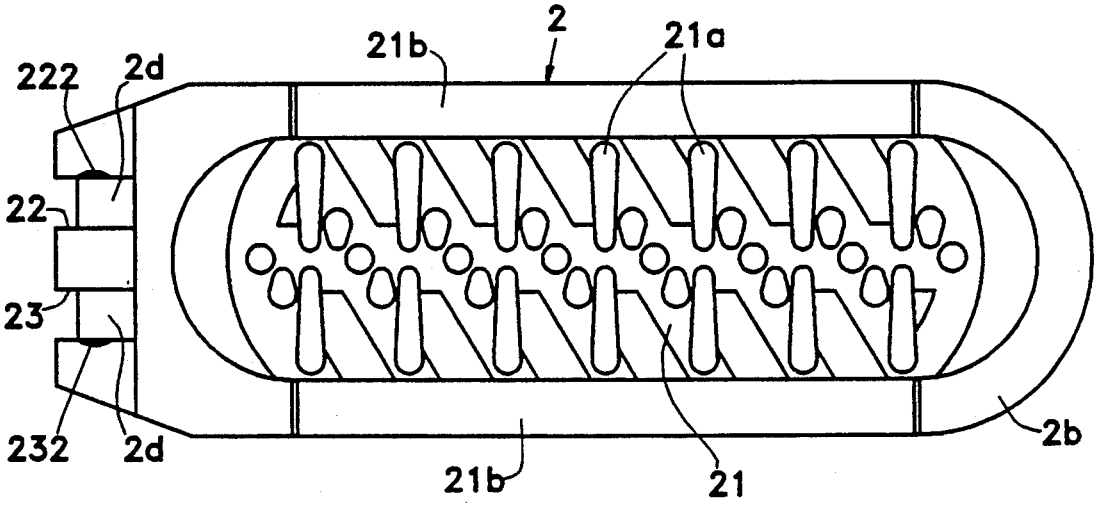
FIG. 4 is a plan view of the brush section of the present invention showing the bristles collapsed for storage or transport.

When a user wants to store the present invention, he can turn the brush bristle membrane 21 inward by merely pressing on the membrane, to cause the brush bristles 21*a* to be concealed inside the brush body (as shown in FIG. 4). Thereafter if he applies a little force on handle 1, he can fold it over the brush section 2 by causing the pivot elements 111 and 122 to rotate in notches 22 and 23. By these techniques a user will achieve a very compact configuration for the purpose of carrying and storing the novel brush.

Another feature of the present invention lies in the design of the brush bristles 21*a* in bristle membrane 21 which are integrally formed with the membrane. This membrane is arranged to create the convex foundation, shown in FIG. 5, for the bristles. When folded inwardly, the bristles 21*a* of the membrane will be collapsed at the central part of the brush section 2 without causing interference or hindrance with each other. The brush portion or section 2 is best shown in FIG. 4 which shows the bristles closed or collapsed. This part of the brush portion 2 includes a u-shaped bow 2*b* formed of a round dowel or rod which is connected to the base portion 2*c* of the brush section 2 containing the notches 22 and 23. The bristle membrane 21, which is generally rectangular, has a cylindrical sleeve 21*b* formed along two if its edges which are opposite one another. When the bristle membrane is flat the bristles extend perpendicularly from one of its surfaces. However, since the width of the membrane between the two cylindrical sleeves is greater than the width between the legs of the u-shaped bow the bristle surface of the membrane will form a convex or concave foundation for the bristles when the cylindrical sleeves are received on the legs of the bow. As a result, the bristles will be disposed as shown in FIG. 5, or as shown in FIG. 4, as the user pushes the bristle face of the membrane between the legs of the u-shaped bow. In this "closed" position the handle can be closed over the bristle section 2, as shown in FIG. 7, to form a compact brush which can be carried in a purse or pocket without inconvenience.

Having described the invention I claim:

1. A collapsible hair brush comprising:

a handle means having a flat shape, said handle means having a pivot means at one end;

a brush means having a central section and a u-shaped bow means having spaced-apart legs with distal ends, said distal ends of its spaced-apart legs fixed in and extending from said central section to form a hollow brush body, said central section also having pivot means formed at its end opposite said u-shaped bow means;

means connecting said pivot means of said handle means with said pivot means of said brush means operable to allow said handle means to be articulated to a first position to overlap said legs of said u-shaped bow means and to a second position whereby said handle means is substantially aligned with said legs, and a flexible, generally rectangular flat bristle membrane means having a plurality of bristles and extending perpendicularly from one of its flat surfaces, said membrane means having cylindrical sleeves along two of its opposite sides, said cylindrical sleeves operably assembled on said legs of said u-shaped bow means which legs are spaced apart with a width less than the width of said membrane between said sleeves whereby said bristles can be closed by pushing said membrane means to one side of said u-shaped means and said handle means can be closed over said bristles when they are closed to form a compact unit when said brush is not in use and said handle means can be opened to form a handle for said brush and said membrane means can be pushed to the other side of said u-shaped bow means to open said bristles.

2. The collapsible hair brush defined in claim 1 wherein the handle means is formed in the shape of a shoe horn so it can be used as such when in its open position.

3. The collapsible hair brush defined in claim 1 where in the bristles extending perpendicularly form the rectangular membrane means are arranged in diagonal rows so they next in a manner that they will not contact one another when said membrane means is forced between the spaced apart legs from an open position which exposes with said bristles.

4. The collapsible hair brush defined in claim 1 where in the means connecting the pivot means of said handle means and the brush means includes locking projections means operable to lock said handle means in its open position.

5. The collapsible hair brush defined in claim 1 wherein the membrane means is sufficiently stiff that it will retain its positions on either side of said u-shaped bow means when so positioned.

* * * * *